United States Patent [19]

Szücs et al.

[11] 4,367,595

[45] Jan. 11, 1983

[54] METHOD AND APPARATUS FOR DRYING PRODUCTS, ESPECIALLY CORN OR PIECE PRODUCTS

[75] Inventors: László Szücs; András Horváth; Emód 'Sigmond; Imre Szabó; Verona Tóth, all of Budapest, Hungary

[73] Assignee: Energiagazdalkodasi Intezet, Budapest, Hungary

[21] Appl. No.: 184,184

[22] Filed: Sep. 4, 1980

[30] Foreign Application Priority Data

Sep. 13, 1979 [HU] Hungary ..... EE2693

[51] Int. Cl.[3] ..... F26B 3/04; F26B 21/08

[52] U.S. Cl. ..... 34/27; 34/32; 34/80; 55/221

[58] Field of Search ..... 55/221, 388; 34/75, 34/77, 80, 81, 27, 32

[56] References Cited

U.S. PATENT DOCUMENTS

| | | | |
|---|---|---|---|
| 2,017,027 | 10/1935 | Forrest . | |
| 2,249,625 | 7/1941 | Bichowsky . | |
| 2,557,204 | 6/1951 | Richardson . | |
| 3,094,574 | 6/1963 | Glasgow et al. . | |
| 3,257,737 | 6/1966 | Margittai . | |
| 3,257,738 | 6/1966 | Margittai . | |
| 3,348,601 | 10/1967 | Hill . | |
| 3,738,016 | 6/1973 | Margittai . | |
| 3,857,911 | 12/1974 | Szucs et al. . | |
| 3,940,860 | 3/1976 | Unterreiner . | |
| 4,009,229 | 2/1977 | Szucs et al. . | |
| 4,189,848 | 2/1980 | Ko et al. | 34/80 |

FOREIGN PATENT DOCUMENTS

| | | | |
|---|---|---|---|
| 317857 | 9/1974 | Austria . | |
| 939336 | 10/1948 | France . | |
| 1031415 | 6/1953 | France | 34/167 |
| 168451 | 11/1975 | Hungary . | |
| 1152440 | 5/1969 | United Kingdom . | |
| 1363523 | 8/1974 | United Kingdom . | |

OTHER PUBLICATIONS

Kathabar "Lufttrocknung".

"Analysis & Development of Regenerated Desiccant System for Industrial & Agricultural Drying", U.S. Dept. of Energy Final Report, Apr. 1977–Dec. 1977; D. V. Merrifieldan, J. W. Fletcher.

*Primary Examiner*—Larry I. Schwartz

*Attorney, Agent, or Firm*—Young & Thompson

[57] ABSTRACT

The invention is, on the one hand, a method for drying products, especially corn or articles, in the course of which the products to be dried are traversed by a drying gas, the moisture content of the drying gas is diminished by contacting it with a desiccant liquid, and the desiccant liquid is at least partly regenerated after the contact. According to the invention, the drying gas stream flows through at least two layers of products to be dried successively, and before or after flowing through each layer of products it is brought into contact with the desiccant liquid. The invention is, on the other hand, an apparatus for drying products, especially corn or articles, which apparatus comprises structure for holding the products to be dried, a device for letting a drying gas flow through the holding structure, a gas processing device for contacting the gas flowing through the holding structure with a desiccant liquid, and structure for regenerating the desiccant liquid, where the apparatus for holding the products to be dried have at least two drying sections which are placed one after the other in the direction of movement of the drying gas stream, and before or after each drying section a gas processing device is placed in the way of the gas stream. Advantageously, the structure for holding the products to be dried are at least one drying path which ensures passing of the products to be dried.

45 Claims, 12 Drawing Figures

METHOD AND APPARATUS FOR DRYING PRODUCTS, ESPECIALLY CORN OR PIECE PRODUCTS

Figure 1:
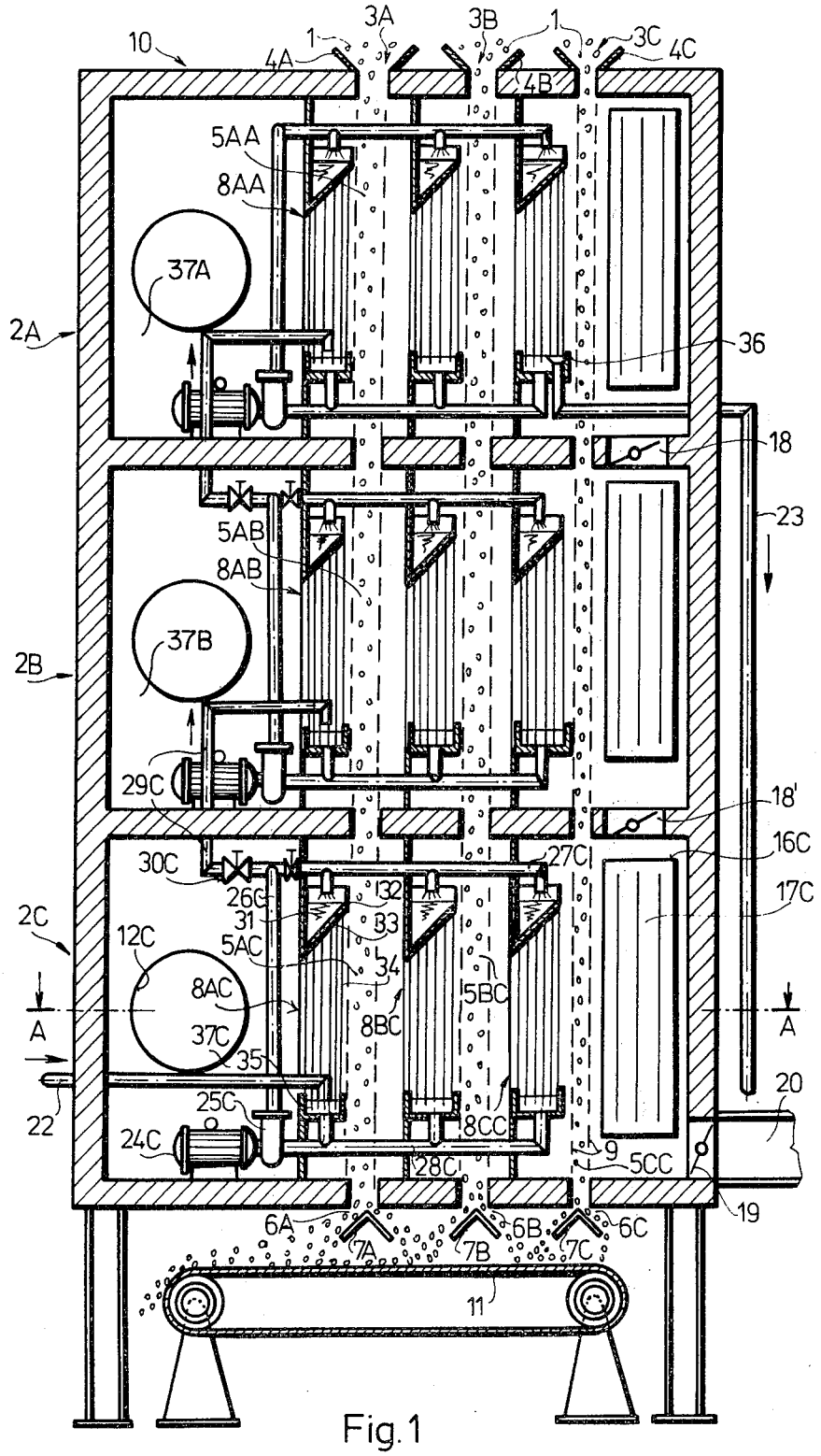

The subject matter of the invention is a method and an apparatus for drying products, especially corn or articles. In the course of drying the products to be dried are traversed by a drying gas whose content of humidity is diminished through contacting it with a desiccant liquid.

There are known solutions where the drying gas stream is driven through the device containing the products to be dried by a ventilator, there the drying gas comes into contact with the products, extracts their content of humidity, then it is driven through a gas processor inside which the gas contacts an adsorbent material and gets rid of its humidity content received earlier. For adsorbent materials, solid adsorbents (e.g. gels and carbon) and desiccant (sorption) liquids (e.g. for the aqueous solution of ethylene glycol or lithium chloride) have been suggested. The continuous drying of the drying gas in this way makes the use of a closed gas stream possible.

In the known solution, when drying with a desiccant liquid, a difficulty arises in that the drying gas can specifically extract five to ten times less moisture from the products to be dried than in case of drying with the usual method, for example by heating the gas. As a consequence, in the drying apparatus working with a desiccant liquid, a five to ten times larger quantity of gas must be moved by ventilators than usual if we wish to apply the well-known method. By appropriate means known-by choosing the speed of the gas to be low-it is possible to achieve a low degree of ventilation work, but the large quantity of gas and the low speed often come to require such a large flow cross-section as cannot be technically realized or can be realized only at an extremely high cost. Another disadvantage is that the ventilator which can carry a large volume at a small pressure loss has a much lower efficiency and is more expensive than the one with the same theoretical rate of power input which carries a lesser quantity against greater pressure loss.

We recognized that the above mentioned disadvantage can be eliminated or diminished according to the invention in such a way that the drying gas stream coming from the driving device, e.g. ventilator, is dried by the desiccant liquid and used for drying the products to be dried not just once but at least two or more times.

So the invention is a method for drying products, especially corn or articles, in the course of which the products to be dried are traversed by a drying gas, the moisture content of the drying gas is diminished by contacting it with a desiccant liquid, and the desiccant liquid is at least partly regenerated after the contact; and it is characterized in that the drying gas stream flows through at least two layers of products to be dried successively, and before or after flowing through each layer of products it is brought into contact with the desiccant liquid.

In the apparatus according to the invention the driving device, e.g. ventilator, drives a lesser volume of gas, e.g. in the case of double drying half as much gas, but against a larger pressure loss, e.g. in the case of double drying against a double pressure loss. For this reason, on the one hand, the by-pass cross-section, the front elevation of the apparatus will be smaller, on the other hand, the ventilator and the apparatus will be less expensive.

Because of the large quantity of gas it is advantageous to apply the new and economic method of gas conducting and processing according to the invention.

According to the known methods the gas is conducted through channels from the drying compartment where the drying gas is contacted with the products to be dried into the gas processor where the moisture received is extracted from the gas by way of contacting it with desiccant liquid. Both the cost and the flow resistance of these channels might make the application of this drying method uneconomical.

According to a practical embodiment of the method according to the invention, the gas stream is conducted between the contact with the desiccant liquid and the adjacent layer of products essentially without alteration of speed and direction. In another embodiment the gas stream is conducted between the contact with the desiccant liquid and the adjacent layer of products essentially without alteration of speed and with an alteration of direction less than 45°. Therefore the desiccant liquid gas processor and the products to be dried must be placed close to one another and in such a way that during the drying process the gas stream suffers the least possible alteration of speed and direction.

In the solution according to the invention the mode of contacting the gas stream and the desiccant liquid according to the invention is very advantageous. According to the known methods, the desiccant liquid is spread in the space serving for contacting the gas and the liquid through pulverization or spraying, which in most cases makes application of drip separators necessary after contacting. This, on the one hand, results in geometrical difficulties about the required placing close to one another or constructing together of the contactor of the gas and the liquid and of the products to be dried, on the other hand, it causes a significant pressure loss. Also, in the case of pulverization or spraying, jets, little slits, narrow openings are applied, inside which the desiccant liquid, usually heavily polluted with dust and dirt originating from the products to be dried, brings about blocking up and encrustation.

These difficulties which in the previous solutions have many times cast doubt on the technical feasibility of the drying with desiccant liquid, especially in case of high resistance products e.g. corn where several series-connected drying and gas processing units are required, can be eliminated in the expedient embodiment according to the invention in such a way that the contact with the desiccant liquid is brought about by at least one liquid layer disposed in the path of the gas stream. It is highly expedient to produce a liquid film on liquid film conducting elements for the contact with the liquid layer, and to flow the gas stream tranversally between the liquid film conducting elements.

Contacting the desiccant liquid and the gas is carried out with liquid flowing in a film and not spread by pulverization or spraying. The desiccant liquid is transported through at least one pile-lock onto a skewed, downwardly directed liquid distributing surface without narrow slits, jets, borings, and from the liquid distributing surface liquid conducting elements e.g. fibres, plates etc. conduct the liquid in a film into the transversally flowing gas stream.

In the technical literature and practice of drying with a desiccant liquid a prejudice has developed according to which drying with a desiccant liquid is predestined for the low temperature drying of products. Because of this prejudice, the condensation heat which comes about in desiccant liquid dryers upon the regeneration of the desiccant liquid is not used for raising the temperature of drying to the maximum temperature permitted, determined by the characteristics of the products to be dried, but for other purposes, e.g. for additional drying. As together with the decrease of temperature the moisture extracting capacity of the gases also decreases, the above mentioned solution in many cases, especially in those of products with high heat resistance e.g. bricks, makes the expense of a desiccant liquid drying very high compared to the traditional methods. On the basis of this recognition, it is expedient to carry out the drying according to the invention with such a high temperature gas as is permitted by the character of the products to be dried, and for this purpose it is practical to heat the drying gas with the desiccant liquid during their contact.

According to an advantageous embodiment the regeneration of the desiccant liquid is carried out by evaporation and the evaporation heat of the steam evaporated from the liquid during evaporation is at least partly fed back into the liquid to be regenerated. The evaporation heat of the evaporated steam can be used for boiling or for heating without boiling the liquid to be regenerated.

It is expedient to have the steam acquired during regeneration of the desiccant liquid condensed by the incoming desiccant liquid to be regenerated. The desiccant liquid which cools during the drying process might be immediately suitable for this but also might have to be cooled additionally first. According to the invention it is expedient to carry out the cooling of the desiccant liquid before the regeneration as a function of the cooling of the liquid during the drying in such a way that the liquid to be regenerated has a predetermined temperature.

The drying method according to the invention can also be applied in such a way that in the drying compartment constructed according to the invention we place the products to be dried in several layers, then we dry them and finally we take the dried products out of the drying compartment. However, it is an extremely advantageous embodiment of the invention if we pass the products to be dried through the drying compartment intermittently or continuously.

This can be carried out according to the invention in such a way that the products to be dried are passed along a drying path, through at least two drying sections through which the gas stream flows successively. So the drying path crosses the drying gas stream at least twice and the drying sections belong to the same path. This embodiment is advantageeous if a smaller amount of products has to be dried on a long path or if the drying gas is air and it dries under conditions similar to those of the environment.

For the drying of a large amount of products, e.g. cereals, according to the invention, it is expedient to transport the same along several parallel product paths, e.g. vertical channels. This can be carried out according to the invention in such a way that the products to be dried are passed along at least two drying paths, and the gas stream flows through the respective drying sections of the drying paths successively. So there are several drying paths crossing the drying gas stream, and the drying sections belong to different paths. Of course the two methods of passing of products described above can be applied together in one dryer.

In the dryer constructed according to the invention it is ultimately the desiccant liquid that dries and, as the case may be, heats the products, so it is particularly important to bring about a counter-current movement between them. As both the heat and the moisture are transported between the products and the desiccant liquid by the drying gas and this in turn is usually agitated by the driving device, e.g. ventilator, according to the known methods, which between the products and the desiccant liquid apply a gas stream to be considered one gas stream from the point of view of thermodynamics or really apply one single gas stream, it is impossible to bring about a counter-current movement.

In many cases it is particularly advantageous to change the speed of drying and heating or even that of temporary recooling and rehumidifying during the drying process. If there is one single gas stream to perform the drying in every section of the drying, this requirement cannot be fulfilled.

According to the invention the above mentioned requirements can be fulfilled in an embodiment of the drying method which carries out the drying of the products with at least two drying gas streams in a number of steps equal to that of the gas streams in such a way that each drying gas stream flows through the drying sections belonging to the respective step. The counter-current movement can be brought about expediently in such a way that in the consecutive steps in the direction of movement of the products to be dried the drying gas stream is contacted with more and more active desiccant liquid, and the desiccant liquid circuits of the individual steps are series-connected in such a way that the desiccant liquid to be regenerated is conducted away from the first step with regard to the direction of movement of the products to be dried, and the regenerated desiccant liquid is conducted back to the last step.

The gas streams used according to the invention can be entirely closed circuit, this is advantageous thermodynamically in many cases. But there are cases in which the drying gas is air, and the characteristics of the products require a drying temperature which supposes application of drying air parameters similar to that of the environment. In such cases closing the drying air circuit is not particularly advantageous, the departing air can be replaced from the atmosphere. In other cases closing the air circuit can be more expensive than the energy savings it could bring about because of difficulties in the geometrical arrangement. It is also possible to have the drying gas stream circulate in a closed circuit only partially, as part of the drying gas must continuously be conducted away and be replaced by fresh gas so that the gases leaving the product can be vented. In yet another case it may be necessary to conduct some gas to the products for treatment of the products (e.g. disinfecting, preservation etc.). Lastly it can be useful, for instance in very cold weather, to heat the products with, besides the desiccant liquid, hot flue gas which is available as a waste matter.

For the above mentioned reasons, an embodiment may also be advantageous wherein the separate gas streams are not entirely isolated but are connected to one another and/or to the atmosphere or with the network providing and transporting the gas through a gas conducting appliance e.g. through an opening which is provided with a shutter or calibrated appropriately.

The most general field of application of the invention is the reduction of water content of products using air as drying gas. In such a case it is highly advantageous to use an aqueous solution of calcium chloride as desiccant liquid because it is much cheaper than the more generally used lithium chloride. The invention is not restricted to reducing the water content only but the drying method according to the invention can also be applied for reducing or eliminating e.g. alcoholic moisture content with gasoline as desiccant solution. In this case the use of a closed gas circuit is required.

The subject matter of the invention is also an apparatus for drying products, especially corn or articles, which apparatus comprises means for holding the products to be dried, a device for letting a drying gas flow through the holding means, a gas processing device for contacting the gas flowing through the holding means with a desiccant liquid, and means for regenerating the desiccant liquid, and is characterized in that the means for holding the products to be dried have at least two drying sections which are placed one after the other in the direction of movement of the drying gas stream, and before or after each drying section a gas processing device is placed in the path of the gas stream.

An advantageous embodiment is one in which the flow cross-section of the drying section and that of the adjacent gas processing device are approximately equal. In an expedient arrangement the drying sections and the gas processing devices are placed alternately, in sandwich fashion in a channel conducting the drying gas stream. It is possible and in case of a closed gas circuit highly advantageous to place the drying sections and the gas processing devices in a closed, e.g. ring-shaped channel conducting the drying gas stream, where they are placed alternately, approximately at a right angle to the axis of the channel. In this arrangement it is expedient for the distance between each drying section and the adjacent gas processing device to be less than the hydraulic diameter of the channel conducting the drying gas stream. The apparatus according to the invention can also be arranged in such a way that the drying sections and the gas processing devices are placed in a channel conducting the drying gas stream in at least two groups which contain drying sections and gas processing devices placed alternately, in sandwich fashion, and the groups are connected to one another in such a way that the same gas stream flows through all groups.

In an extremely advantageous embodiment of the apparatus according to the invention the means for holding the products to be dried are at least one drying path which ensures the passing of the products to be dried. The path passing the products continuously or periodically can be arranged in several different ways e.g. it can be a vertical channel with gas-permeable walls, the bulk goods e.g. corn moving downwards in it under the effect of gravitation, or a channel with gas permeable walls where the products are moved by a transportation device.

An expedient embodiment of the apparatus according to the invention is one in which there are at least two drying paths, and said at least two drying sections are situated in different drying paths. In such as case it is practical to form several drying modules along the drying paths, each drying module contains its own device for letting the drying gas flow and its own processing devices placed between the drying sections belonging to that module. In this embodiment consisting of such drying modules, counter-current movement between the products to be dried and the desiccant liquid can be brought about according to the invention in such a way that the gas processing devices of each module are provided with at least one device for circulating the desiccant liquid, the circulating devices of the first and the last drying modules are connected to the means for regenerating the desiccant liquid, and the circulating devices of the other drying modules are connected to the circulating devices of both the preceding and the following drying modules.

In the apparatus according to the invention, the path of the products to be dried can also be arranged so that it comprises one single meandering drying path whose parts constitute said at least two drying sections. This embodiment is highly advantageous for drying of articles to be dried for a longer time. The drying path is expediently formed by a conveyor moving in cross-counter-current or cross-direct-current with the drying gas stream, and the gas processing devices are placed between sections of the conveyor, transversely to the gas stream.

An embodiment of the apparatus according to the invention is extremely advantageous wherein each gas processing device is provided with means for forming a liquid layer of the desiccant liquid. The means for forming a liquid layer are comprised by a device for producing at least one liquid film which device may be constructed so that it comprises a channel receiving the incoming desiccant liquid, at least one lock or weir for accumulating and distributing the desiccant liquid from the channel onto a downwards directed liquid distributing surface, liquid film conducting elements connected to the liquid distributing surface and a liquid collecting channel connected to the liquid film conducting elements. The drying gas stream flows between the liquid film conducting elements transversely, the elements are disposed in at least one vertical plane.

In the apparatus according to the invention the desiccant liquid, e.g. an aqueous solution of calcium chloride, is regenerated by a multi-stage flash evaporator or an evaporator consisting of several bodies, this makes a highly economical regeneration possible.

Figure 2:
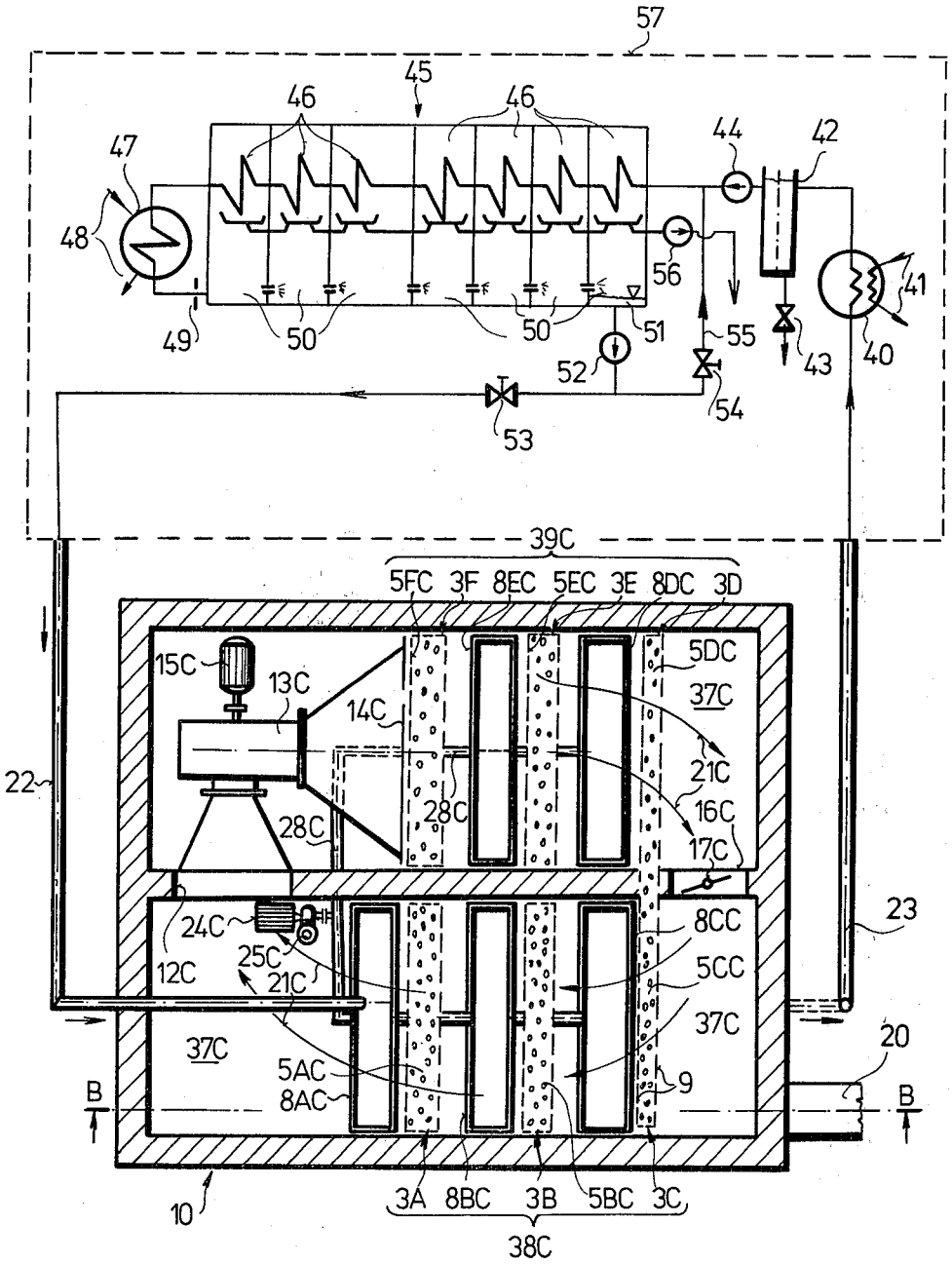
Figure 3:
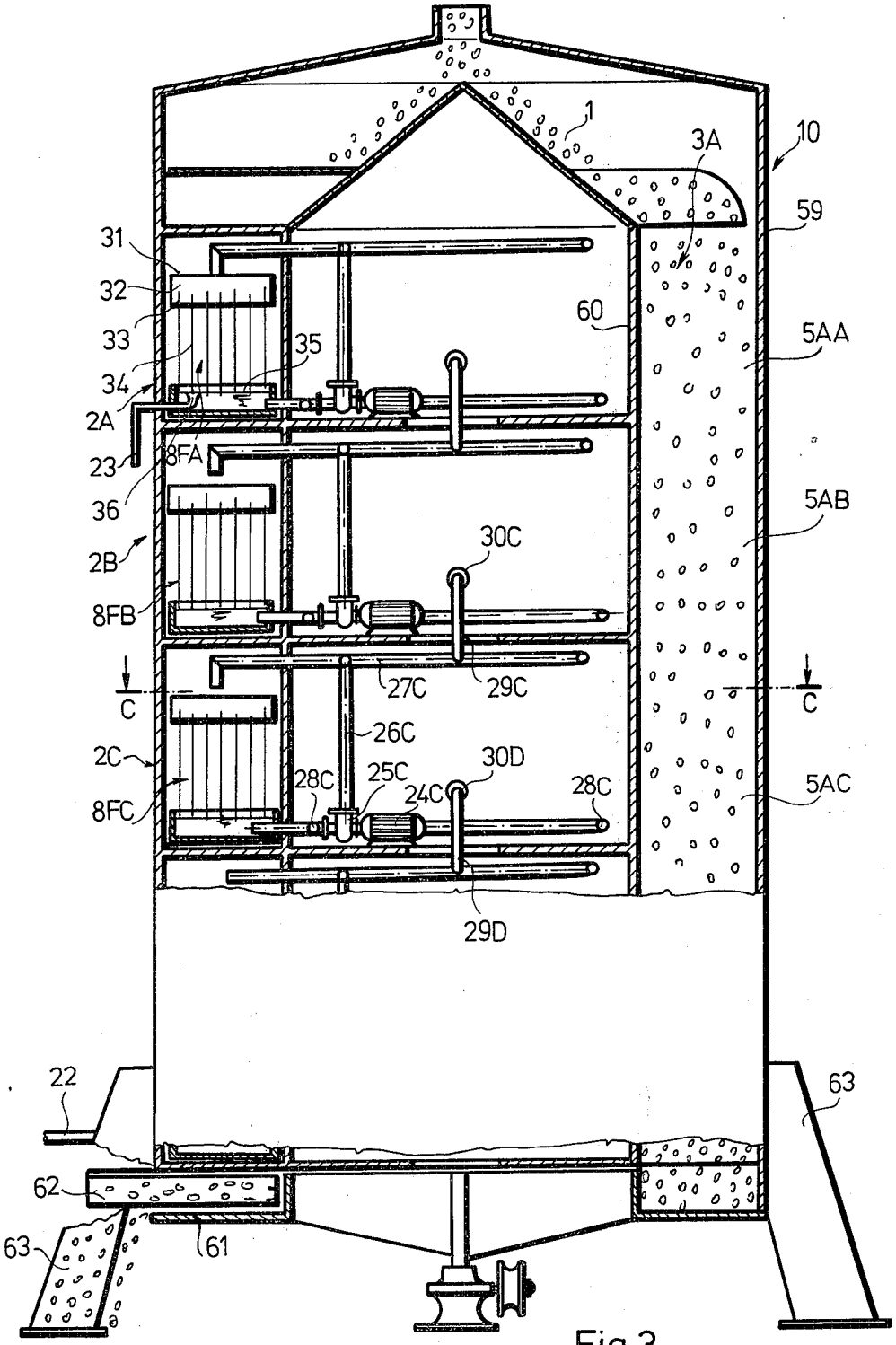
Figure 4:
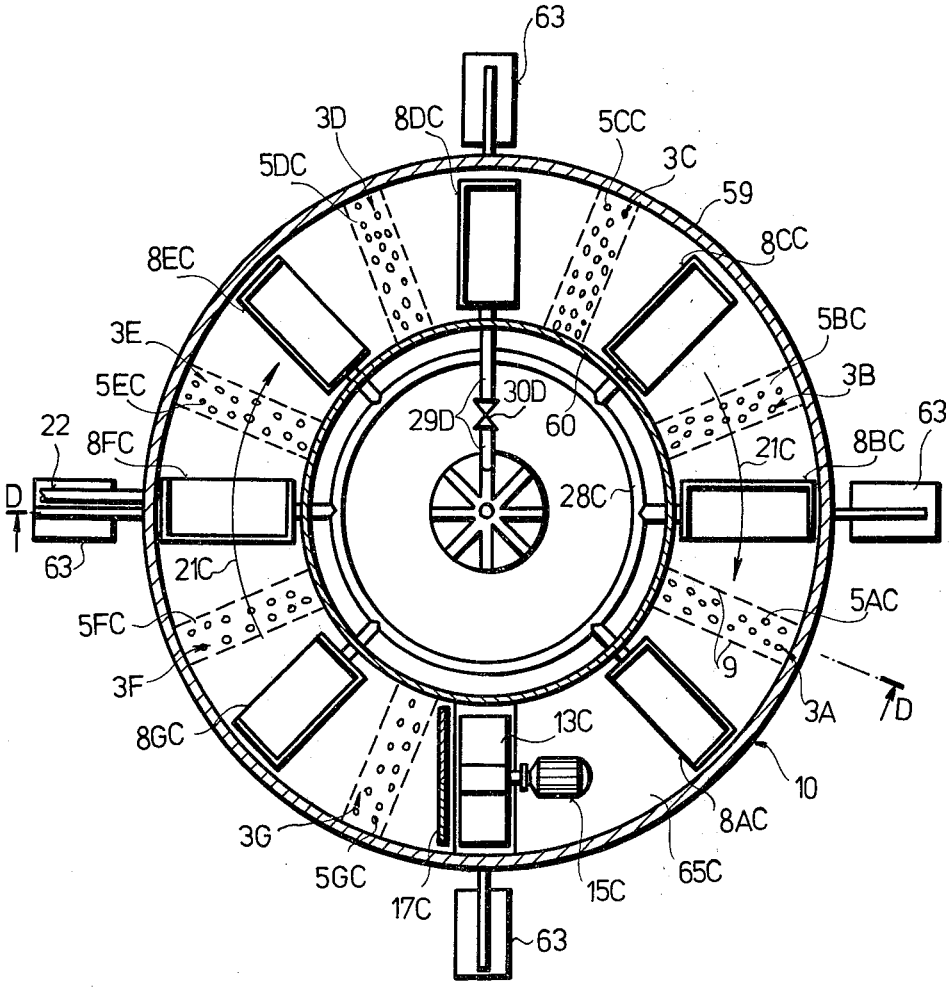
Figure 5:
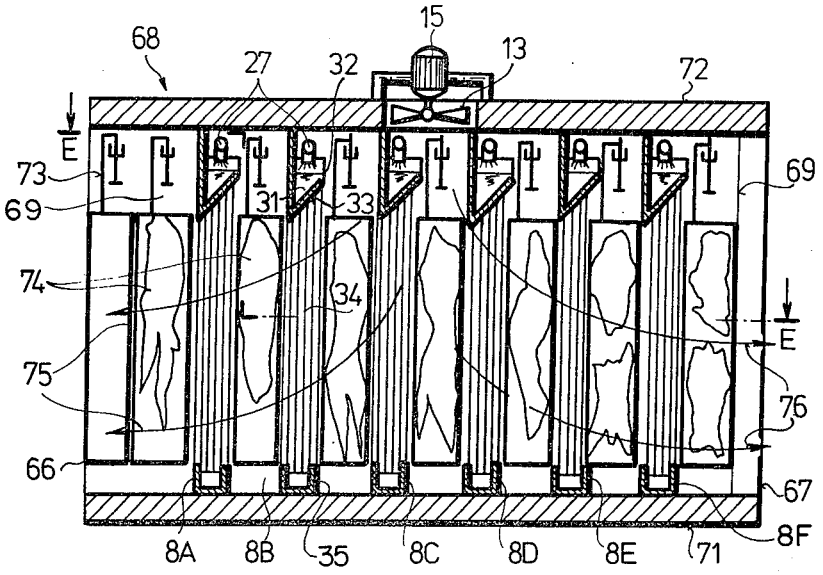
Figure 6:
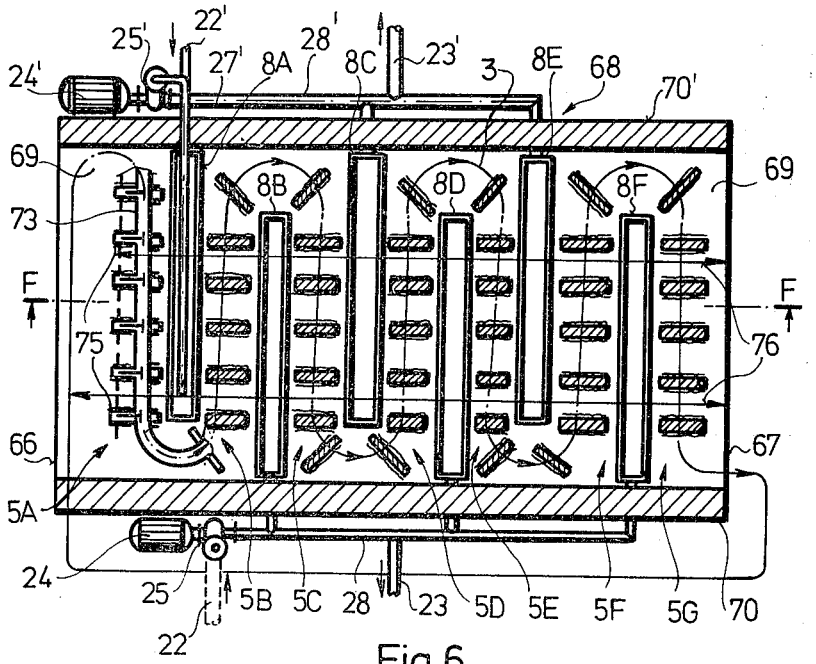
Figure 7:
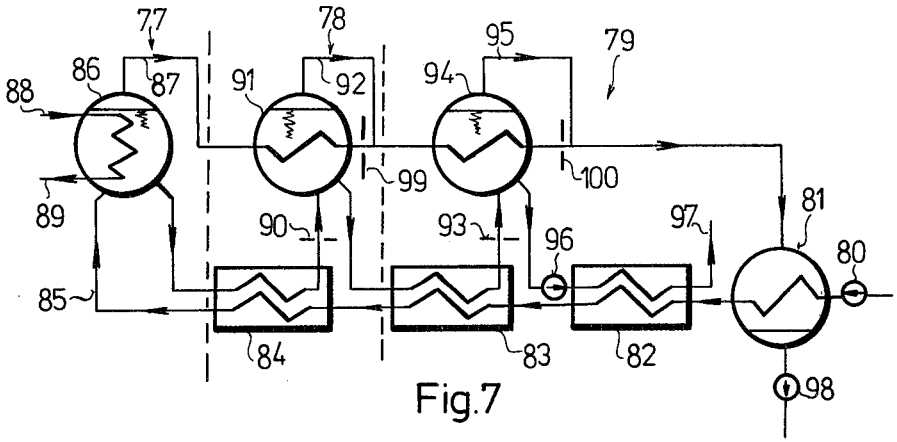
Figure 8:
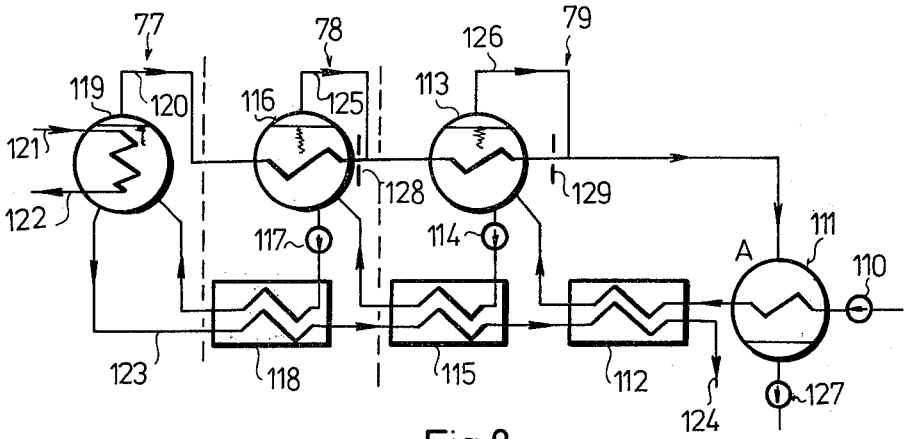
Figure 9:
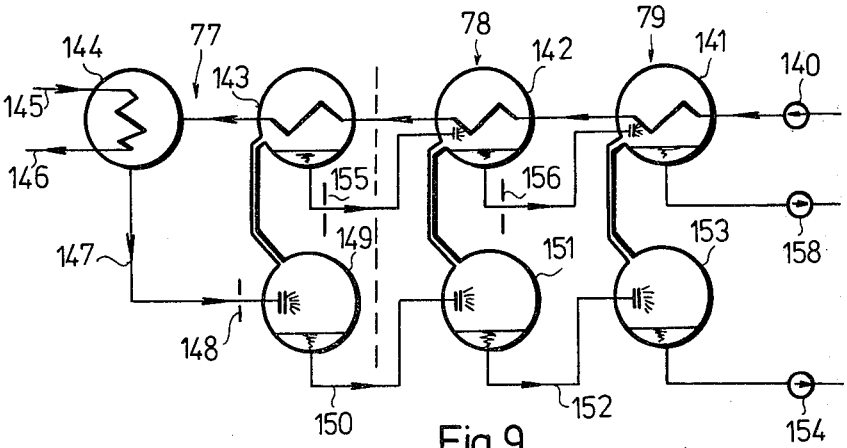
Figure 10:
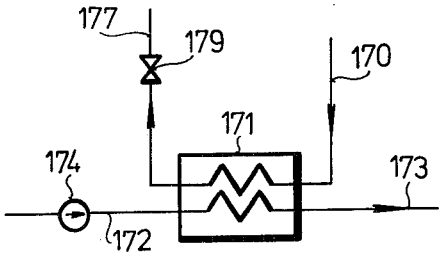
Figure 11:
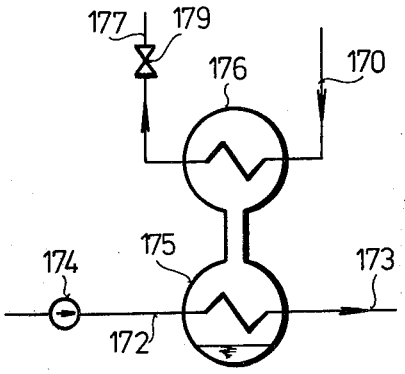
Figure 12:
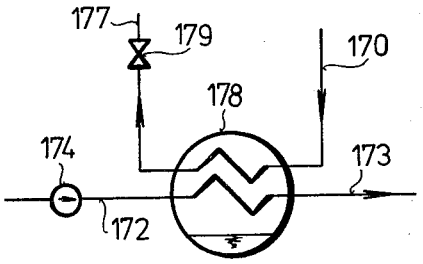

The invention will be hereinafter described on the basis of advantageous embodiments as shown in the drawings, wherein FIG. 1 is a vertical cross-section taken along plane B—B- of FIG. 2 of an apparatus having a drying body of rectangular shape, suitable for drying of an agricultural product e.g. corn, FIG. 2 is a horizontal cross-section of the apparatus shown in FIG. 1, taken along plane A—A, FIG. 3 is a vertical cross-section taken along plane D—D of FIG. 4, of a drying body of a circular apparatus for drying of an agricultural product e.g. corn, FIG. 4 is a horizontal cross-section of the drying body shown in FIG. 3, taken along the plane C—C, FIG. 5 is a vertical cross-section taken along plane F—F of FIG. 6, of a drying body of an apparatus for drying leather goods transported on a horizontal conveyor, FIG. 6 is a vertical cross-section of the drying body shown in FIG. 5, taken along plane E—E, FIG. 7 is a flow diagram of co-current desiccant liquid regenerating equipment applicable in the drying apparatus according to the invention, FIG. 8 is a flow diagram of counter-current desiccant liquid regenerating equipment applicable in the drying apparatus according to the invention, FIG. 9 is a flow diagram of multi-stage flash regenerating equipment for a desiccant liquid applicable in the drying apparatus according to the invention, FIGS. 10 to 12 are flow diagrams of solutions serving for cooling the desiccant liquid to be regenerated, applicable in the regenerating equipment shown in FIGS. 7 to 9.

In the figures elements of the same or similar function are indicated with the same reference number.

FIGS. 1 and 2 show an embodiment of the drying apparatus in the drying body 10 of which the products 1 to be dried, e.g., corn, move downwards continuously, under the influence of gravity, along parallel drying paths 3A, 3B, 3C, 3D, 3E and 3F. The products 1 enter the drying paths 3A, 3B and 3C through the throats 4A, 4B and 4C, and leave them through gates 6A, 6B and 6C whose cross-section can be adjusted with the help of damming elements 7A, 7B and 7C and thus the speed of movement of the products 1 along drying paths 3A, 3B and 3C can also be determined. Similar throats and gates belong to drying paths 3D, 3E and 3F; they are not shown in the drawing. The dried products leaving through the gates are transported to the next technological process by one or two conveyor belts 11.

The drying body 10 consists of drying modules 2A, 2B and 2C placed above one another, and the drying of the product 1 takes place in the shown embodiment in three steps according to the three drying modules 2A, 2B and 2C. Each drying path has three drying sections, e.g. the drying path 3A has drying sections 5AA, 5AB and 5AC. Inside each drying module, desiccant liquid gas processing devices are placed between the drying sections. Each drying module 2A, 2B and 2C is equipped with its own gas stream conducting channel 37A, 37B and 37C, respectively, its own device for causing the drying gas to flow its own device for circulating the desiccant liquid. As the drying modules 2A, 2B and 2C are constructed to be approximately identical, only the drying module 2C is going to be described henceforth as it can be seen in both figures, and the drying modules 2A and 2B are going to be dealt with only in so far as they contain parts different from those of drying module 2C.

In the drying module 2C the device for causing the drying gas to flow is a ventilator 13C, driven by an electric motor 15C, with an inlet orifice 12C and a delivery orifice 14C. The drying gas stream flows through the drying sections and the gas processing devices which are placed in two groups 39C and 38C alternately, in sandwich fashion, and flows through the orifice 16C in the direction of the arrows 21C. In the first group 39C in the direction of the gas stream there are drying section 5FC, gas processing device 8EC, drying section 5EC, gas processing device 8DC and drying section 5DC. To the second group 38C belong drying section 5CC, gas processing device 8CC, drying section 5BC, gas processing device 8BC, drying section 5AC and gas processing device 8AC. The flow cross-sections of the drying sections and the gas processing devices presented to the drying gas stream are approximately equal. It can be seen that the drying section 5AC forms a part of the drying path 3A, the drying section 5BC forms a part of the drying path 3B, etc. The quantity of the gas stream circulated can be regulated by adjustment of the shutter 17C situated in the orifice 16C. The products conducting structure of each drying path is formed by parallel gas-permeable walls 9 which ensure the vertical movement of the products and an approximately horizontal flow of the gas stream through the layer of products in the direction of the arrows 21C. The gas-permeable walls 9 can be formed by perforated sheets or wire-cloth with an appropriate mesh. In the embodiment shown in the drawing the products 1 passing along the drying paths form product layers of approximately equal thickness with the exception of the drying paths 3C and 3D inside which the layer of products is roughly half as thick as in the other paths. With respect to this, between the drying sections 5DC and 5CC there is no gas processing device, the moisture extracted by the gas stream in the drying sections 5DC and 5CC is removed after the drying section 5CC by the gas processing device 8CC. During the drying procedure the moisture extracted by the drying gas stream from the products 1 in the drying sections 5FC, 5EC, 5BC and 5AC is removed by the gas processing device 8EC, 8DC, 8BC and 8AC, respectively, which follow the respective drying sections.

The drying apparatus according to the invention can operate in such a way that each drying module has a separate gas stream of its own. In such a case the shutters 18 between the drying modules 2A and 2B and the shutters 18, between the drying modules 2B and 2C are closed. If, for instance in case of application of air, an air flow between the drying modules is required or the whole drying body 10 has to be open to the environment, this can be achieved with the adjustment of the shutters 18 and 18' as well as the shutter 19 which closes an inlet channel 20 of the drying module 2C.

The gas processing devices 8AC, 8BC, 8DC, 8EC and 8FC are the same and in the embodiment shown they produce a desiccant liquid film. The device for producing the liquid film comprises an upper channel 31 receiving the incoming active desiccant liquid, a weir or lock 32 which accumulates and distributes the desiccant liquid from the channel 31 onto a downwardly directed liquid distributing surface 33, liquid film conducting elements 34, e.g. fibers or strips, connected to the liquid distributing surface 33, and a lower channel 35 which collects the desiccant liquid flowing down on the liquid film conducting elements 34. The gas stream flows transversely between the liquid film conducting elements 34, and comes into an intimate contact with the desiccant liquid. As a result of the contact the moisture content of the gas stream diminishes and that of the desiccant liquid increases, that is, the latter becomes diluted. The gas processing devices can be arranged in ways different from the one displayed. Several applicable embodiments have been described in Hungarian Pat. No. 168,451 and in the U.S. Pat. Nos. 3,857,911 and 4,009,229.

Each drying module 2A, 2B and 2C has a desiccant liquid circulating device of its own. In the drying module 2C this circulating device is formed by a lower collecting pipeline 28C which goes from the liquid collecting lower channels of the gas processing devices 8AC, 8BC, 8CC, 8DC and 8EC to a pump 25C, the pump 25C driven by the electric motor 24C, and an upper distributing pipeline 27C which transports the desiccant liquid from the pump 25C through the pressure pipeline 26C into the upper channel 31 of the gas processing devices. Besides the circulation a continuous regeneration of the diluted desiccant liquid must also be ensured. This is provided according to the invention in the embodiment as shown with one single regenerating means 57 in such a way that the regenerated, active desiccant liquid goes through the pipeline 22 into the lowest drying module 2C, e.g. into the lower channel 35 of the gas processing device 8AC, and the diluted desiccant liquid goes from the uppermost drying module 2A, e.g. from the overflow 36, through the pipeline 23 into the regenerating means 57, and the desiccant liquid circulating devices of the drying modules 2C, 2B and 2A are connected in series. The series connection is such that a connecting pipeline 29C is connected to the pressure pipeline 26C, the connecting pipeline 29C has a regulating valve 30C, and the connecting pipeline 29C takes the desiccant liquid to the circulating device of the drying module 2B, e.g. into the lower channel of one of the gas processing devices. The proportion of the quantity of the desiccant liquid circulated in the drying module 2C and that of the desiccant liquid transported into the drying module 2B situated above the former can be regulated by the appropriate adjustment of the valve 30C. The quantity of the diluted desiccant liquid coming into the drying module 2B must be regulated by the adjustment of the valve 30C in such a way that in the lower channels 35 of the drying module 2C the liquid level is constant. In this way the desiccant liquid while moving from the bottom upwards becomes more and more diluted, and in the uppermost drying module 2A at the overflow 36 the liquid contains the moisture extracted from the products 1 in all drying modules. This embodiment ensures an advantageous counter-current movement between the products 1 and the desiccant liquid as the relatively driest products 1 in the lowest drying module 2C meet the most active desiccant liquid with the help of the gas stream there. A condition of this counter-current movement is that the gas streams circulating in the individual drying modules 2A, 2B and 2C are at least partly separated from one another.

Naturally, the drying body 10 according to the invention which dries in several steps can be embodied with two or more than three drying modules unlike the embodiment shown, or can have some other number or shape of the drying paths, again, unlike the embodiment shown. The drying module 2B in the middle can be omitted, or several stages identical with the drying module 2B can be inserted between the first drying module 2A and the last drying module 2C. A great manufacturing advantage of the embodiment shown here is that all the drying modules are of practically identical construction, moreover, the holders and wall-parts of the drying body 10 can also be integrated the drying module, so the whole drying body 10 can be built by placing and fixing prefabricated drying modules onto one another, this results in a reductor of assembly work on the spot.

Another advantage is that the products to be dried can not only be heated but also cooled besides drying by determining the temperature of the desiccant liquid circulating in the individual drying modules. In the drying of grain products, e.g. corn, it can be very advantageous in the upper drying modules to dry the corn while it is heated up to the highest possible temperature, and to cool it back to the required temperature during drying in the lowest drying module. The function of cooling can be fulfilled by a drying module which is constructed basically in the same way as the other modules. Naturally, cooling of the corn can also be realized with traditional equipment which blows in cold air, combined with the drying modules according to the invention.

The regenerating means 57 shown by a schematic circuit diagram in FIG. 2 decrease the moisture content of the diluted desiccant liquid arriving continuously through the pipeline 23, and continuously deliver the regenerated active desiccant liquid through the pipeline 22. The regenerating means 57 shown regenerate the desiccant liquid by evaporation, and can be used advantageously when the desiccant liquid is e.g. an aqueous solution of calcium chloride. As the units of the regenerating means 57 are pre se known in the chemical industry, it is sufficient to provide only a circuit diagram in the figure.

The diluted desiccant liquid incoming through the pipeline 23 flows into a settling tank 42 through a heat exchanger 40. In the heat exchanger 40 the incoming desiccant liquid is cooled, e.g. by cooling water entering through the pipes 41, said water being provided e.g. by a cooling tower not shown in the figure. This cooling is essential in a given case because—as will be shown in the examples below—it is the incoming diluted desiccant liquid which is to condense the steam evaporated from itself later on by regeneration. For this purpose, the incoming diluted desiccant liquid may not be cool enough as its degree of cooling in the drying body 10 is liable to changes as a function of the weather and the temperature of the entering products to be dried. For this reason, according to the invention, it is expedient to provide a subsidiary cooling of a regulating character which ensures that the diluted desiccant liquid entering the evaporator, e.g. a multi-stage flash evaporator 45, always has a predetermined temperature. Some possible embodiments of this additional cooling are shown in FIGS. 10 to 12 to be described below.

In the settling tank the pollution contained in the desiccant liquid, originating from the products to be dried, settles out. It is expedient to arrange the settling tank 42 in such a way, well-known in itself, that both the pollution settling on the bottom and that floating on the surface can be separated from the liquid. To this end it is necessary to place the outlet orifices of the settling tank 42 towards the pump 44 below the liquid surface. The settling tank 42 is provided with a drain valve 43.

The pump 44 pumps the diluted desiccant liquid into recuperative heat exchangers 46, into a heat exchanger 47 heated e.g. by steam through pipes 48 and through a throttle 49 into evaporating chambers 50 of the multi-stage flash evaporator 45. In the space above the evaporating chambers 50 utilization of the evaporation heat of the steam evaporated from the desiccant liquid takes place for preheating the desiccant liquid to be condensed. The reactivated desiccant liquid 51 produced in the multi-stage flash evaporator 45 is pumped by a pump 52 through a valve 53 and through the pipeline 22 into the drying body 10. If necessary at the start or for reasons concerning regulation, it is possible to feed back the whole or a part of the condensed desiccant liquid, which is much warmer than the liquid incoming through the pipeline 23, through the pipeline 55 by appropriate adjustment of the valves 54 and 53. The condensate produced in the multi-stage flash evaporator 45 is carried away by a pump 56.

FIGS. 3 and 4 show a vertical and a horizontal cross-section, respectively, of a drying body 10 of circular ground-plan. In the drying body 10 the products 1 to be dried move downwards from above by the effect of gravitation. Similarly to the embodiment shown in along FIGS. 1 and 2, the products 1 here too move on drying paths 3A, . . . 3G which are parallel to the direction of movement of the products and each of which consists of several drying sections in accordance with the drying modules 2A, 2B and 2C, e.g. the drying path 3A consists of drying sections 5AA, 5AB and 5AC. In this embodiment however the drying sections and the gas processing devices are placed from the point of view of the ground-plan alternately in a ring between the outer wall 59 and the inner wall 60, e.g. in the drying module 2C in the direction of the gas stream circulated in the direction of the arrows 21C there are the drying sections 5GC, 5FC, 5EC, 5DC, 5CC, 5BC and 5AC and after each of them a gas processing device 8GC, 8FC, 8EC, 8DC, 8CC, 8BC and 8AC, respectively. The gas stream is circulated by a ventilator 13C driven by the electric motor 15C, its flow rate can be regulated by adjusting the shutter 17C, and the channel 65C conducting the gas stream is a ring with a rectangular cross-section in which the drying sections and the gas processing devices are placed radially. The products 1 to be dried entering from above pass along the drying paths 3A, . . . 3G which are provided with gas permeable walls 9 and onto the rotating tray 61 whence a deflecting blade 62 which is in a fixed position takes the dried products away. The speed of movement of the products 1 along the drying paths 3A, . . . 3G can be regulated by alteration of the speed of taking the products away, that is, by alteration of the speed of rotation of the tray 61. The drying body 10 stands on feet 63.

The desiccant liquid system of the drying body 10 in FIGS. 3 and 4 is the same as that shown in FIGS. 1 and 2. Each drying module 2A, 2B and 2C is provided with a liquid circulating device of its own, these are series-connected in such a way that the desiccant liquid returning from the gas processing devices flows at least partly into the liquid space of the next drying module. The desiccant liquid system is connected to the regenerating means not shown in the figure through the pipeline 22 entering the lowest drying module and through the pipeline 23 outgoing from the uppermost drying module which is the drying module 2A in the figure. The regenerating means may be that shown in FIG. 2 by the reference number 57. Inside the drying body 10 there is counter-current here too, between the products 1 to be dried and the desiccant liquid.

The drying body 10 according to FIGS. 3 and 4 can also be formed in such a way that it can be built up on the site from prefabricated drying modules.

FIGS. 5 and 6 show a drying body 68 and a drying path 3 different from those of the embodiments shown above. A base 71, a ceiling 72 and walls 70 and 70' of the drying body 68 form a horizontal channel 69 conducting the drying gas stream. The drying gas is air from the environment which is forced in by a ventilator 13 driven by an electric motor 15 fixed on the ceiling 72 in the middle of the channel 69, approximately at an equal distance from the two ends 66 and 67 of the channel 69, leading out to the open air. The air forced in in the middle while streaming towards the two ends 66 and 67 of the channel 69 brings about two air streams of opposite directions in accordance with the direction of the arrows 75 and 76. In this embodiment both air streams are entirely open as they depart into the environment at the ends 66 and 67.

In the channel 69, which forms a drying tunnel, the products to be dried which are advantageously piece products move from left to right on a sinuous drying path 3. The drying path 3 has sections which are transverse to the axis of the channel 69 and turning parts of 180° connecting these sections. In the embodiment shown the drying path 3 is formed by a continuously moving conveyor 73 which moves in cross-counter-current with the first air stream flowing left and in cross-co-current with the second air stream flowing right. The products to be dried e.g. leather pieces 74 are fixed e.g. onto frames of the conveyor 73. The sections of the conveyor 73 which are transverse to the first and second air streams, and in the figure make a substantially right angle with them, form the drying sections 5A, . . . 5G, between which the desiccant liquid gas processing devices 8A, . . . 8E are placed in such a way that in the direction of the air streams each drying section is followed by a gas processing device except at the ends 66 and 67 of the channel 69 where after the last drying section 5A and 5G, respectively the first and second air streams depart into the environment. During the drying each of the first and second air streams becomes wet in the respective drying section, then is dried in the gas processing device, then becomes wet again in the next drying section, then is dried in the next gas processing device, etc.

The gas processing devices 8A, . . . 8F are arranged in the same way as those shown in FIGS. 1 and 2. In all of them, the active desiccant liquid flows from an upper channel 31 through a weir or lock 32 onto a downwardly directed liquid distributing surface 33, and from there onto liquid film conducting elements 34. The desiccant liquid which has initmately contacted the first and second gas stream and so has become diluted with humidity is collected in a lower channel 35. From the channels 35 of the gas processing devices 8B, 8D and 8F the desiccant liquid—e.g. an aqueous solution of calcium chloride of 40 to 50% concentration—flows through a common lower collecting pipeline 28 into a pump 25 driven by an electric motor 24 which through an upper distributing pipeline not shown in the figure pumps the desiccant liquid into upper channels 31 of the gas processing devices 8B, 8D and 8F, that is, circulates the desiccant liquid in the gas processing devices 8B, 8D and 8F. The desiccant liquid to be regenerated is conducted from the lower collecting pipeline 28 through the pipeline 23 into the regenerating means not shown in the figure. The regenerating means can be identical e.g. with that shown in FIG. 2. The regenerated, active desiccant liquid enters the upper distributing pipeline, not shown in the figure, through the pipeline 22. An identical circulating and regenerating system is provided for the gas processing devices 8A, 8C and 8E which consist of a lower collecting pipeline 28', an outlet pipeline 23' connected to it, a pump 25' driven by an electric motor 24', an upper distributing pipeline 27' and an incoming pipeline 22' connected to it. The pipelines 23' and 22' are connected to the regenerating means not shown in the figure which can be identical with that shown in FIG. 2. It is obvious that in the embodiment according to FIGS. 5 and 6 there are two separate desiccant liquid systems, but regeneration can be carried out with just one regenerating means. The temperature of the active desiccant liquid required for appropriate heating of the products to be dried can be determined in the regenerating means.

In the embodiments shown in the FIGS. 1 to 5 the means for holding the products to be dried were one or more drying paths continuously passing the products. However it is obvious that the invention is not restricted to continuous passing but an intermittent transportation can just as well be used, and it is not necessary at all to move the product to be dried during the drying according to the invention. According to the invention the drying can be carried out also in such a way that the products to be dried are placed in the drying compartment in a layered arrangement, then the drying is carried out according to the invention, and finally the dried products are taken out of the drying compartment.

FIGS. 7 to 9 show multi-effect regenerating means advantageously usable in the drying apparatus according to the invention. In FIG. 7 a circuit diagram of a direct-current evaporator is shown in which the incoming diluted desiccant liquid is at the beginning heated and later boiled by the steam evaporated from the desiccant liquid during evaporation.

The cool, diluted liquid, after precooling as the case may be, coming from the drying body 10 through the pipeline 23 (e.g. FIG. 3) is pumped into the condenser 81 by the pump 80, where the liquid cools the condenser 81, then the liquid is further heated in the heat exchanger 82, 83 and 84 inside which the diluted liquid cools the evaporated liquid. Then the heated, diluted liquid flows through the pipeline 85 into the boiler 86 of the first stage 77. In the boiler 86 by the effect of adding heat from outside steam evaporates from the liquid and departs through the pipeline 87. The heating medium for the boiler 86 enters through the pipe 88 and leaves through the pipe 89. The liquid evaporated in the boiler 86 flows through the heat exchanger 84 and the throttle 90 into the middle stage 78 of the evaporator, that is, into the boiler 91. In the boiler 91 the liquid is further evaporated by the steam which was produced in the first stage 77 and which entered through the pipeline 87. The steam produced here departs through the pipeline 92 to the last stage 79 where the liquid further evaporated also flows from the boiler 91 through the heat exchanger 83 and the throttle 93. In the boiler 94 the steam incoming through the pipeline 92 and the steam-liquid mixture incoming from the boiler 91 through the throttle 99 heats the liquid. The active liquid brought from the last stage 79 is carried away by the pump 96 through the heat exchanger 82 to the pipe 97 where the evaporator is connected to the pipeline 22 leading to the drying body 10 (e.g. FIG. 3). The steam produced in the last stage 79 and departing through the pipeline 95 and the steam part of the steam-liquid mixture incoming through the throttle 100 is condensed by the cool, diluted liquid in the condenser 81. The condensate produced here and the non-condensed gases are carried away from the evaporator by the pump 98.

In FIG. 8 a circuit diagram of a counter-current evaporator is shown in which the incoming diluted desiccant liquid is heated by the steam evaporated from the liquid during evaporation.

The desiccant liquid coming from the drying body 10 through the pipeline 23 (e.g. FIG. 6), after precooling as the case may be, is pumped into the condenser 111 by the pump 110 where it condenses the steam produced in the last stage 79 of the evaporator. Then the diluted liquid cools the active liquid departing from the evaporator in the heat exchanger 112 and afterwards flows into the boiler 113 of the last stage 79. From there the liquid is moved through the heat exchanger 115 to the boiler 116 by the pump 114. This is the middle stage 78 of the evaporator. From the middle stage 78 the liquid is moved through the heat exchanger 118 to the boiler 119 of the first stage 77 by the pump 117. Here, by adding heat from outside, steam is evaporated from the diluted liquid which flows through the pipeline 120 into the middle stage 78 and supplies its heating. The heating medium from outside enters through the pipe 121 and leaves the boiler 119 through the pipe 122. The produced hot and active liquid departs through the pipeline 123 and through the heat exchangers 118, 115 and 112 and is connected to the pipeline 22 leading to the drying body 10 (e.g. FIG. 6) through the pipe 124. The steam produced in the last stage 79 and departing through the pipeline 126 is liquefied in the condenser 111 from which the condensate and the non-condensed gases are carried away by the pump 127. The condensate produced in the heating steam space of the boilers is always conducted to the next stage with the help of the throttle 128 and 129, respectively.

FIG. 9 shows the circuit diagram of regenerating means in which the steam evaporated from the liquid to be condensed only preheats the liquid to be condensed but does not evaporate it.

The cold, diluted liquid coming from the drying body 10 through the pipeline 23 (e.g. FIG. 1), after precooling as the case may be, is carried first through the condensers 141, 142 and 143 by the pump 140 where the liquid gets heated while it liquefies the steam produced in the evaporators 149, 151 and 153. The diluted, gradually warming liquid flows into the heat exchanger 144 where, by adding heat from outside, it gets further heated. The heating medium added from outside enters through the pipe 145 and departs through the pipe 146. The diluted liquid heated up almost to the saturation temperature flows through the pipeline 147 and the throttle 148 into the evaporator 149 of the first stage 77. The throttle 148 always has to be regulated in such a way that the pressure of the diluted liquid while passing through the series of condensers is always greater than the saturation pressure, so evaporation does not take place anywhere. In the evaporator 149 steam is evaporated from the liquid without adding heat from outside, that is, the liquid becomes more condensed. The steam produced departs to the condenser 143 where the diluted liquid liquefies the steam as described above. The more condensed liquid producd in the evaporator 149 departs to the evaporator 151 of the middle stage 78 through the pipeline 150, there again steam is evaporated from it. Then the liquid flows into the evaporator 153 of the last stage 79 through the pipeline 152 where it is further condensed. The active liquid is carried to the pipeline 22 of the drying body 10 (e.g. FIG. 1) by the pump 154.

The condensate produced in the condensers 143 and 142 is to be conducted through the throttles 155 and 156, respectively into the next stage, that is, into the condenser 142 or 141, respectively. In the last stage 79 the water collected in the condenser 141 and the non-condensed gases are carried away by the pump 158.

In FIGS. 7, 8 and 9 showing different applicable solution, there is in each a circuit which includes a first stage 77, a middle stage 78 and a last stage 79, that is, the evaporator always consists of three stages. This is not necessarily so all the time. By changing the number of the middle stage 78 a two stage or a more-than-three stage evaporator can also be constructed in the case of all the three circuits. A larger number of stages is advantageous in respect of increasing the efficiency.

The last stage 79 is always cooled by the cooled, diluted liquid coming from the drying body, which in many cases is not sufficiently cool to carry out the task of cooling. In such cases the diluted liquid has to be cooled additionally as was described in connection with FIG. 2. In FIGS. 10 to 12 three solutions for the auxiliary cooling of the diluted liquid are shown.

FIG. 10 shows auxiliary cooling where the diluted liquid coming from the drying body is cooled by cooling water. The cold cooling water from the pipe 170 cools the diluted liquid from the pipeline 172 in the liquid-liquid heat exchanger 171. Through the pipe 173 the cooled liquid enters the condenser of the evaporator, e.g. the condenser 81, 111 or 141 of FIG. 7, 8 or 9, respectively. The diluted liquid is pumped by the pump 174 which can be the pump 80, 110 or 140 of FIG. 7, 8 or 9, respectively. The auxiliary cooling can be regulated by inserting a valve 179 in the pipeline of the cooling water.

FIG. 11 shows an auxiliary cooling by a condenser built into a separate body. The auxiliary cooling is provided by the auxiliary condenser 176 which is cooled by water and connected to the condenser 175 on the steam and liquid side. The condenser 175 in turn is cooled by the diluted liquid from the pipeline 172. The cooling water enters the auxiliary condenser 176 through the pipe 170 and departs through the pipe 177. The pump 174 is equivalent e.g. to the pump 80, 110 or 140 of FIG. 7, 8 or 9, respectively. The auxiliary cooling can be regulated here too by the valve 179.

FIG. 12 shows an auxiliary cooling by a condenser built into the same body. The condenser 178 which is equivalent e.g. to the condenser 81, 111 or 141 of FIG. 7, 8 or 9, respectively, has one steam space but its space on the liquid side is divided in two. In one bundle of flows the diluted liquid pumped by the pump 174 in the pipeline 172, in the other bundle of flows the cooling water entering through the pipe 170 and departing through the pipe 177. The auxiliary cooling here too can be regulated by the valve 179.

We claim:

1. In a method of drying products, comprising the steps of flowing a drying gas stream so as to cause it to pass the product to be dried; contacting the drying gas stream with a desiccant liquid to remove moisture from the gas; and regenerating the desiccant liquid by circulating at least a part of it through regenerating means to remove moisture therefrom; the improvement comprising arranging the product to be dried in at least two product parts; conducting said flowing so that the drying gas stream passes said at least two product parts successively; and performing said contacting each time before the drying gas stream passes each of said at least two product parts or each time after the drying gas stream passes each of said at least two product parts, the drying gas, in the course of passing said product parts once, being subjected to a plurality of said contacting steps for moisture removal with said contacting steps alternating with the flow of the drying gas stream past each of a plurality of said product parts.

2. The method according to claim 1, in which said drying gas stream is conducted between the desiccant liquid and the adjacent product part substantially without any alteration of velocity and with a directional change of less than 45°.

3. The method according to claim 2, in which said drying gas stream is conducted between the desiccant liquid and the adjacent product part substantially without any alteration of velocity and direction.

4. The method according to claim 1, in which said contacting is performed by at least one desiccant liquid layer disposed in the path of the drying gas stream.

5. The method according to claim 4, in which said at least one desiccant liquid layer is produced by causing the desiccant liquid to flow on liquid film conducting elements, and said contacting is performed by causing said drying gas stream to pass between said liquid film conducting elements.

6. The method according to claim 4, and altering the temperature of the product to be dried so that heat is transmitted by the drying gas stream between the desiccant liquid layer and the product to be dried.

7. The method according to claim 6, in which said altering of the temperature of the product to be dried is performed by heating the desiccant liquid before said contacting and then heating the drying gas stream by said contacting.

8. The method according to claim 1, in which said desiccant liquid is a desiccant solution.

9. The method according to claim 8, in which said drying gas is air and said desiccant solution is an aqueous solution of calcium chloride.

10. The method according to claim 8, in which said regenerating is carried out by a multi-effect evaporation of the desiccant solution; and the steam evaporated from the desiccant solution is at least partly condensed by the desiccant solution to be regenerated.

11. The method according to claim 8, in which said regenerating is carried out by multi-stage flashing.

12. The method according to claim 11, and cooling said desiccant solution after said contacting and before said regenerating.

13. The method according to claim 12, in which said cooling of the desiccant solution is performed in dependence of the cooling of the desiccant solution during said contacting so that the incoming desiccant solution to be regenerated is of a predetermined temperature.

14. The method according to claim 1, in which said arranging is performed by moving the product to be dried along a drying path having drying sections constituting said at least two product parts; and conducting said flowing so that the drying gas stream passes said at least two drying sections of said path successively.

15. The method according to claim 1, in which said arranging is performed by moving the product to be dried along at least two drying paths each having at least one drying section; and conducting said flowing so that the drying gas stream passes the drying sections of different drying paths successively.

16. The method according to claim 15, in which said at least two drying paths are vertical.

17. The method according to claim 16, in which said moving of the product to be dried is performed along said at least two vertical drying paths downward by gravity.

18. The method according to claim 15, in which said moving of the product to be dried is continuous.

19. The method according to claim 15, in which said drying of the product is carried out with at least two drying gas streams in at least two drying steps, wherein the number of said drying steps equals the number of said drying gas streams and each of said drying paths has as many drying sections as the number of said drying steps, in such a way that each of said drying gas streams passes the drying sections of the respective drying step.

20. The method according to claim 19, in which said drying gas streams belonging to different drying steps are separated from each other.

21. The method according to claim 19, in which said drying gas streams belonging to adjacent drying steps communicate with each other.

22. The method according to claim 19, in which each of said drying gas streams is contacted with a more concentrated desiccant liquid than the desiccant liquid contacting the previous drying gas stream with respect to the direction of movement of the product to be dried.

23. The method according to claim 19, in which each of said at least two drying gas streams is circulated in a closed cycle.

24. In an apparatus for drying products, comprising means for holding the product to be dried; means for contacting a drying gas stream with a desiccant liquid to remove moisture from the gas; gas conducting and circulating means for causing at least one said drying gas stream to flow through said holding means and said contacting device; regenerating means for removing moisture from the desiccant liquid; and liquid circulating means for circulating at least a part of the desiccant liquid through said regenerating means and said contacting device; the improvement in which said holding means includes at least two drying sections (5AC, . . . 5FC; 5A, . . . 5G); said gas conducting means (59, 60; 70, 70', 71, 72) are arranged to cause the drying gas stream to flow along a path through said drying sections successively; and said contacting means comprises at least two contacting devices (8AC, . . . 8EC; 8A, . . . 8F) with one of said at least two contacting devices disposed either before each of said drying sections along said path of the drying gas stream or after each of said drying sections along said path of the drying gas stream, the arrangement being such that the drying gas, in the course of passing said product parts once, is subjected to a plurality of said contacting steps for moisture removal with said contacting steps alternating with the flow of the drying gas stream past each of a plurality of said product parts.

25. The apparatus according to claim 24, in which the flow cross section of each of said drying sections (e.g. 5AC) and the flow cross section of the adjacent contacting device (e.g. 8AC, 8BC) are approximately equal.

26. The apparatus according to claim 24, in which said gas conducting means constitute a channel (69) for the drying gas stream; and said drying sections (5A, . . . 5G) and said contacting devices (8A, . . . 8F) are disposed alternately, in sandwich fashion in said channel.

27. The apparatus according to claim 24, in which said gas conducting means constitute a closed channel (65C) for the drying gas stream; and said drying sections (5AC, . . . 5GC) and said contacting devices (8AC, . . . 8GC) are disposed in alternation in said channel substantially at a right angle to the axis of said channel.

28. The apparatus according to claim 24, in which said gas conducting means constitutes a closed channel (37C) for the drying gas stream; and said drying sections (5AC, . . . 5FC) and said contacting devices (8AC, . . . 8EC) are disposed in said channel in at least two groups (38C, 39C); each of said groups including drying sections and contacting devices disposed alternately in sandwich fashion.

29. The apparatus according to claim 26, in which the distance between each of said drying sections (e.g. 5B) and the adjacent contacting device (e.g. 8A, 8B) is less than the hydraulic diameter of said channel (69) for the drying gas stream.

30. The apparatus according to claim 24, in which said holding means comprises at least one drying path (3A, . . . 3F; 3) for moving the product to be dried.

31. The apparatus according to claim 30, in which said holding means comprise at least two drying paths (3A, . . . 3F); and said at least two drying sections (5AC, . . . 5FC) are situated along different drying paths.

32. The apparatus according to claim 31, in which said drying sections (5AC, . . . 5FC) are formed by product conducting devices with gas permeable walls (9); and each of said contacting devices (8AC, . . . 8EC) is placed between two product conducting devices.

33. The apparatus according to claim 31, comprising several drying modules (2A, 2B, 2C) along said drying paths (3A, . . . 3F); each drying module having its own gas conducting and circulating means, its own drying sections in said drying paths and its own contacting devices disposed between said own drying sections.

34. The apparatus according to claim 33, in which each of said drying modules (e.g. 2C) has its own desiccant liquid circulating device (e.g. 24C, . . . 28C) for said own contacting devices (e.g. 8AC, . . . 8EC); the liquid circulating devices of the first and last drying modules (2A, 2C) being connected to said liquid circulating means; and the liquid circulating devices of the other drying modules (2B) being connected to the liquid circulating devices of both the preceding and the following drying modules (2A, 2C).

35. The apparatus according to claim 33, in which said drying paths (3A, . . . 3F) are vertical.

36. The apparatus according to claim 35, in which said vertical drying paths (3A, . . . 3F) are formed so that the product to be dried moves downward by gravity.

37. The apparatus according to claim 31, in which said drying paths have transportation devices for moving the product to be dried.

38. The apparatus according to claim 30, in which said holding means comprises a single sinuous drying path (3), portions of which constitute said at least two drying sections (5A, . . . 5G).

39. The apparatus according to claim 38, in which said single drying path (3) is formed by a conveyor (73) moving in cross-counter-current or cross-co-current with the drying gas stream; and said contacting devices (8A, . . . 8F) are disposed between sections of the conveyor (73), said sections being transverse to the direction of movement of the drying gas stream.

40. The apparatus according to claim 30, in which each said contacting device (8AC, . . . 8EC; 8A, . . . 8F) comprises means for producing at least one layer of the desiccant liquid.

41. The apparatus according to claim 40, in which said means for producing at least one liquid layer comprises a device for producing at least one liquid film.

42. The apparatus according to claim 41, in which said liquid film producing device comprises a channel (31) for receiving and holding the incoming desiccant liquid, at least one weir (32) to guide in film form the desiccant liquid out of said channel (31), liquid distributing means having at least one distributing surface (33), connected to said at least one weir (32) and facing downward, liquid film conducting elements (34) connected to said liquid distributing surface (33), and a liquid collecting channel (35) connected to said liquid film conducting elements (34).

43. The apparatus according to claim 42, in which said liquid film conducting elements (34) are arranged in at least one substantially vertical plane.

44. The apparatus according to claim 40, in which said regenerating means (57) comprises a multi-stage flash evaporator (45).

45. The apparatus according to claim 40, in which said regenerating means (57) comprises a multi-effect evaporator.

* * * * *